US006790055B1

(12) United States Patent
Shiu et al.

(10) Patent No.: US 6,790,055 B1
(45) Date of Patent: Sep. 14, 2004

(54) STRADDLE ELECTRICAL CONNECTOR WITH TWO-STAGE CONNECTING CLAMP

(75) Inventors: Guo-Jiun Shiu, Tu-chen (TW); Chuck Pickles, York, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/650,382

(22) Filed: Aug. 27, 2003

(51) Int. Cl.[7] ..... H01R 12/00
(52) U.S. Cl. ..... 439/79; 439/260
(58) Field of Search ..... 439/59, 60, 79–81, 439/260, 876, 942

(56) References Cited

U.S. PATENT DOCUMENTS 5,584,708 A 12/1996 Leong
6,644,995 B1 * 11/2003 Jones et al. ..... 439/260
6,679,716 B2 * 1/2004 Nakagawa et al. ..... 439/267

* cited by examiner

*Primary Examiner*—Tho D. Ta
*Assistant Examiner*—Ann McCamey
(74) *Attorney, Agent, or Firm*—Wei Te Chung

(57) ABSTRACT

A straddle electrical connector (1) attached to a circuit substrate (60) includes a housing (10), upper contacts (30) and lower contacts (40) accommodated in the housing, and a clamp (20) attached with the housing. Each upper contact includes a bent portion (34). During insertion of the circuit board, the bent portions of the upper contacts are received in the clamp, thereby the upper contacts are heightened. Then, the circuit substrate is put between the upper contacts and the lower contacts with zero insertion force. The circuit substrate is pushed, thereby the clamp is pushed by the circuit substrate to disengage the bent portions of the upper contacts and attached to the housing. The upper contacts rebound and grasp the circuit substrate cooperating with the lower contact.

7 Claims, 7 Drawing Sheets

STRADDLE ELECTRICAL CONNECTOR WITH TWO-STAGE CONNECTING CLAMP

BACKGROUND OF THE INVENTION

1. Field of the Invention

The present invention relates to an electrical connector, and particularly to a straddle electrical connector having a two-stage connecting clamp attached to an edge of a circuit substrate such as a printed circuit board (PCB).

2. Description of Prior Art

So-called straddle electrical connectors are connected to edges of circuit boards, the circuit boards having electrical traces on both surfaces thereof. The straddle electrical connector has two rows of electrical contacts, each contact having a contact section. The edge of the circuit board is inserted between the rows of contact sections of the straddle connector. The contacts are connected to corresponding electrical traces using soldering techniques such as surface mount technology (SMT).

An example of a conventional straddle connector is shown in FIG. 6. The connector 8 is for being attached to an edge of a printed circuit board (PCB) 85. The connector 8 comprises an insulative housing 80, and a number of electrical contacts 81 arranged in two rows in the housing 80. Under normal conditions, contact sections 811 of the contacts 81 are inclined toward each other due to their resilience. The circuit board 85 comprises conductive pads 851, 852, and solder coatings 853, 854 attached to the conductive pads 851, 852 respectively. A distance between the soldering sections 812 of the contact sections 811 is less than an overall thickness of the circuit board 85 at the solder coatings 853, 854. Once the connector 8 is engaged on the edge of the circuit board 85, the contact sections 811 are soldered to corresponding conductive pads 851, 852 using an infra red light source or another kind of heat source.

When the connector 8 is mounted on the circuit board 85, the contact sections 811 are prone to scrape the solder coatings 853, 854 off from the conductive pads 851, 852. This is because the distance between the soldering sections 812 of the contact sections 811 is less than the overall thickness of the circuit board 85 at the solder coatings 853, 854. On the other hand, if the distance between the soldering sections 811 were greater than the overall thickness of the circuit board 85, it would be highly problematic or impossible to solder the soldering sections 811 to conductive pads 851, 852 via the solder coatings 853, 854. Yet when the solder coatings 853, 854 are scraped off, adequate soldering of the soldering sections 812 to the conductive pads 851, 852 cannot be obtained. Therefore, the reliability of the soldered connections may be substantially reduced.

A number of efforts have been made to improve the reliability of SMT techniques. For example, FIG. 7 shows a straddle connector 9 as disclosed in U.S. Pat. No. 5,584,708. The connector 9 comprises an insulative housing 91, electrical contacts 92 arranged in two rows in the housing 91, and a dielectric separator 93 movably located in a channel 923 of the housing 91. The housing 91 is molded from a suitable insulative plastic, and has a flat configuration for insertion of an edge of a circuit board 95 into the channel 923. Spaced conductive pads 951 are located on both surfaces of the circuit board 95 at the edge thereof. The conductive pads 951 are coated with solder (not shown). Connection sections 921 of the contacts 92 are brought to a position suitable for SMT connection. A distance between the opposite connection sections 921 of the contacts 92 is less than a thickness of the circuit board 95. Guide ends 9211 of the connection sections 921 are cooperatively flared for facilitating insertion of the circuit board 95.

Before the connector 9 is connected to the circuit board 95, the separator 93 is retained in the channel 923 near a mating face of the connector 9. The separator 93 keeps the connection sections 921 spaced apart so as not to touch the conductive pads 951 of the circuit board 95. When the circuit board 95 is inserted in the channel 923, a leading edge of the circuit board 95 comes into contact with the separator 93, and pushed the separator 93 further into the channel 923. When the circuit board 95 is completely inserted in the channel 923, the separator 93 is disposed in an inmost part of the channel 923. As a result, the connection sections 921 resiliently rebound and press onto the conductive pads 951. That is, when the connector 9 is connected to the edge of the circuit board 95, the distance between the connection sections 921 automatically changes to freely receive and then engage the circuit board 95. During this process, the connection sections 921 do not scrape solder from the conductive pads 951.

However, the connector 9 requires the flared guiding ends 9211 at distal ends of the contacts 92 in order to guide the circuit board 95 into the channel 923. Therefore, when the contacts 92 are soldered to the circuit board 95, the molten solder cannot completely cover the guiding ends 9211. As a result, when the connector 9 transmits high-frequency signals in operation, the guiding ends 9211 are prone to produce cross talk. The performance and specifications of the connector 9 are diminished.

A new straddle electrical connector that overcomes the above-mentioned disadvantages is desired.

SUMMARY OF THE INVENTION

Accordingly, an object of the present invention is to provide a straddle electrical connector for attachment to a circuit substrate such as a printed circuit board (PCB), wherein the connector does not scrape solder coatings off from conductive pads of the PCB during attachment.

Another object of the present invention is to provide a straddle electrical connector for attachment to a circuit substrate such as a PCB, wherein the connector greatly reduces or even eliminates cross talk during transmitting high-frequency signals.

To achieve the above-mentioned objects, a straddle electrical connector in accordance with a preferred embodiment of the present invention is for being attached to a PCB. The electrical connector comprises an insulative housing, upper contacts and lower contacts accommodated in the housing, and a clamp attached with the housing. Each upper contact comprises a bent portion. During insertion of the PCB, the bent portions of the upper contacts are received in the clamp; thereby the upper contacts are raised. Then, the PCB is inserted between the upper contacts and the lower contacts with zero insertion force. The PCB then pushes the clamp so that the bent portions of the upper contacts are disengaged from the clamp. The upper contacts accordingly rebound and engage the PCB cooperatively with the lower contacts.

Other objects, advantages and novel features of the invention will become more apparent from the following detailed description when taken in conjunction with the accompanying drawings, in which:

DETAILED DESCRIPTION OF THE PREFERRED EMBODIMENT OF THE INVENTION

Reference will now be made to the drawings to describe the present invention in detail.

Figure 1:
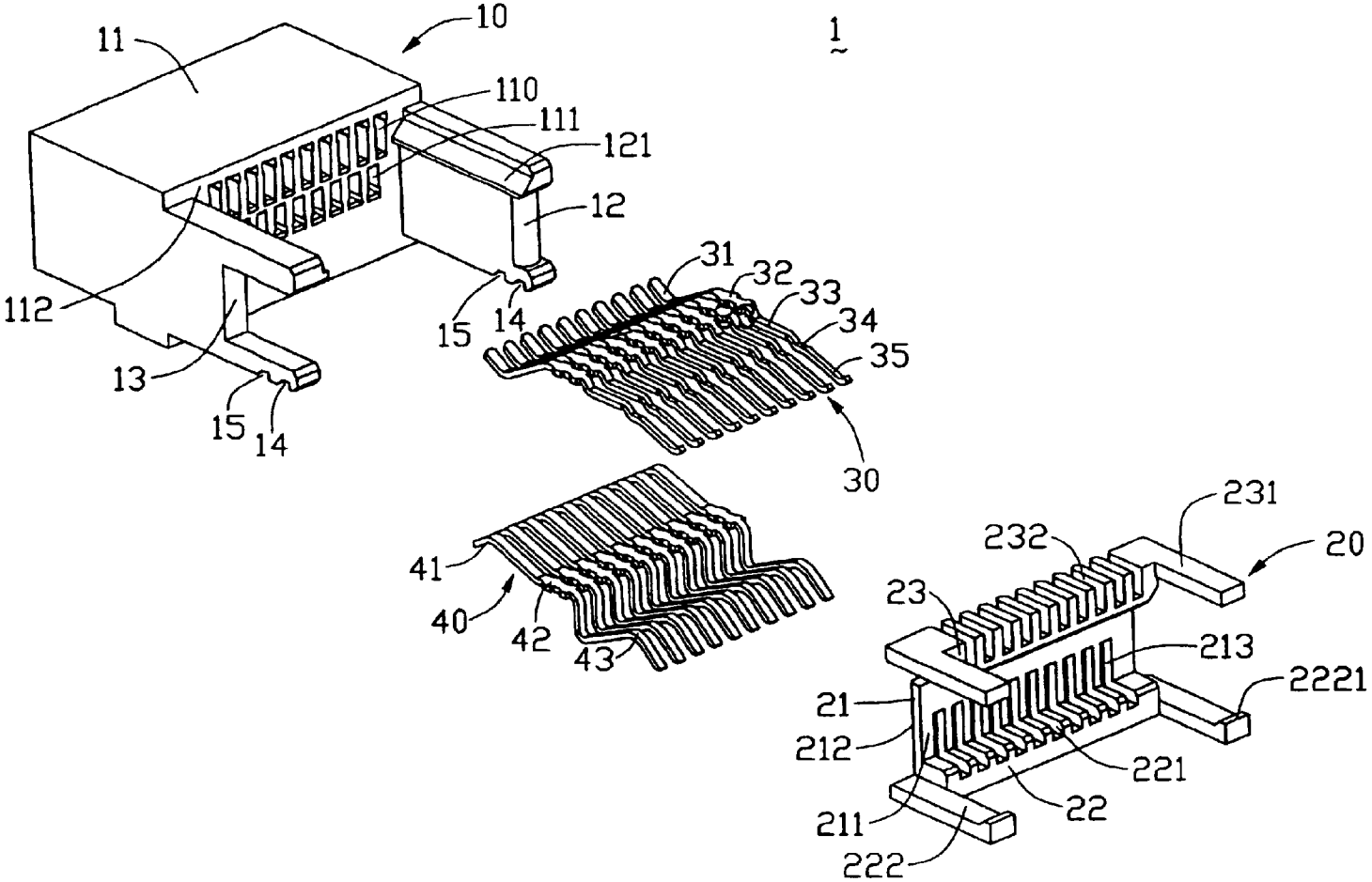
FIG. 1 is an exploded, isometric view of a straddle electrical connector in accordance with the preferred embodiment of the present invention.

FIG. 1 shows essential parts of a straddle connector 1 in accordance with the preferred embodiment of the present invention. The connector 1 is for being attached to an edge of a printed circuit board (PCB) 60 (see FIG. 4). The connector 1 comprises an insulative housing 10, a clamp 20 attached with the housing 10, and a row of upper contacts 30 and a row of lower contacts 40 partly accommodated in the housing 10.

The housing 10 comprises a body 11 with a contacting surface 112 defined thereon, and parallel first and second extending portions 12, 13 extending in a same direction from opposite ends of the contacting surface 112 respectively. The body 11 defines a row of upper passageways 110, and a row of lower passageways 111. Each of the first and second extending portions 12, 13 defines a positioning slot 14 in a bottom of distal end portion thereof; and a retaining slot 15 adjacent the positioning slot 14, between the positioning slot 14 and the contacting surface 112. The first extending portion 12 forms a beveled guiding portion 121 along an upper section thereof.

Figure 2:
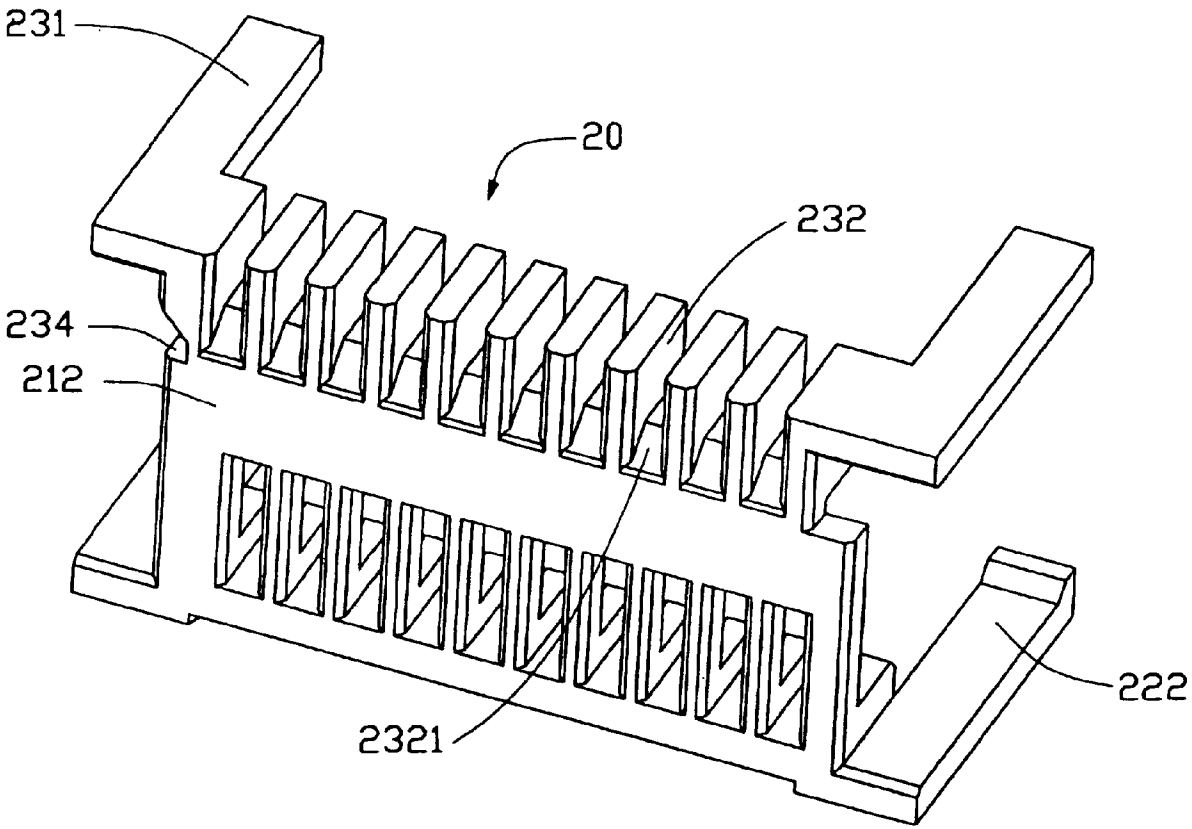
FIG. 2 is an enlarged view of a clamp of the connector of FIG. 1, viewed from another aspect.

FIG. 2 is an enlarged view of the clamp 20 of the connector 1, but viewed from another aspect. Referring to FIGS. 1 and 2, the clamp 20 comprises a base portion 21, and a positioning portion 22 and a supporting portion 23 perpendicularly extending from opposite bottom and top ends of the base portion 21 respectively. The base portion 21 comprises a front surface 211, a back surface 212, and a plurality of parallel through slots 213 spanning between the front surface 211 and the back surface 212. The positioning portion 22 comprises a pair of parallel positioning arms 222 at opposite ends thereof respectively. The positioning portion 22 defines a plurality of receiving slots 221 therein; the receiving slots 221 respectively communicating with corresponding through slots 213. Each positioning arm 222 forms a block 2221 at a distal end thereof. The supporting portion 23 comprises a pair of parallel supporting arms 231 at opposite ends thereof respectively. The supporting portion 23 defines a plurality of supporting slots 232 therein; the supporting slots 232 respectively corresponding to the receiving slots 221. The supporting portion 23 also defines a guiding slot 234 in a side wall thereof, the guiding slot 234 being parallel to the supporting arms 231. A plurality of guiding faces 2321 is defined in the supporting portion 23 at the supporting slots 232 respectively. Each guiding face 2321 adjoins the back surface 212 of the base portion 21.

Referring to FIG. 1, each upper contact 30 comprises, in sequence, an upper contacting portion 31, an upper retaining portion 32, a connecting portion 33, a bent portion 34, and a soldering portion 35. The bent portion 34 bends downwardly from the connecting portion 33 to the soldering portion 35. A distal end of the soldering portion 35 is curved slightly upwardly.

Each lower contact 40 comprises, in sequence, a lower contacting portion 41, a lower retaining portion 42, and a flexing portion 43. A structure of the lower contacting portion 41 is the same as that of the upper contacting portion 31, and a structure of the lower retaining portion 42 is the same as that of the upper retaining portion 32.

Figure 4:
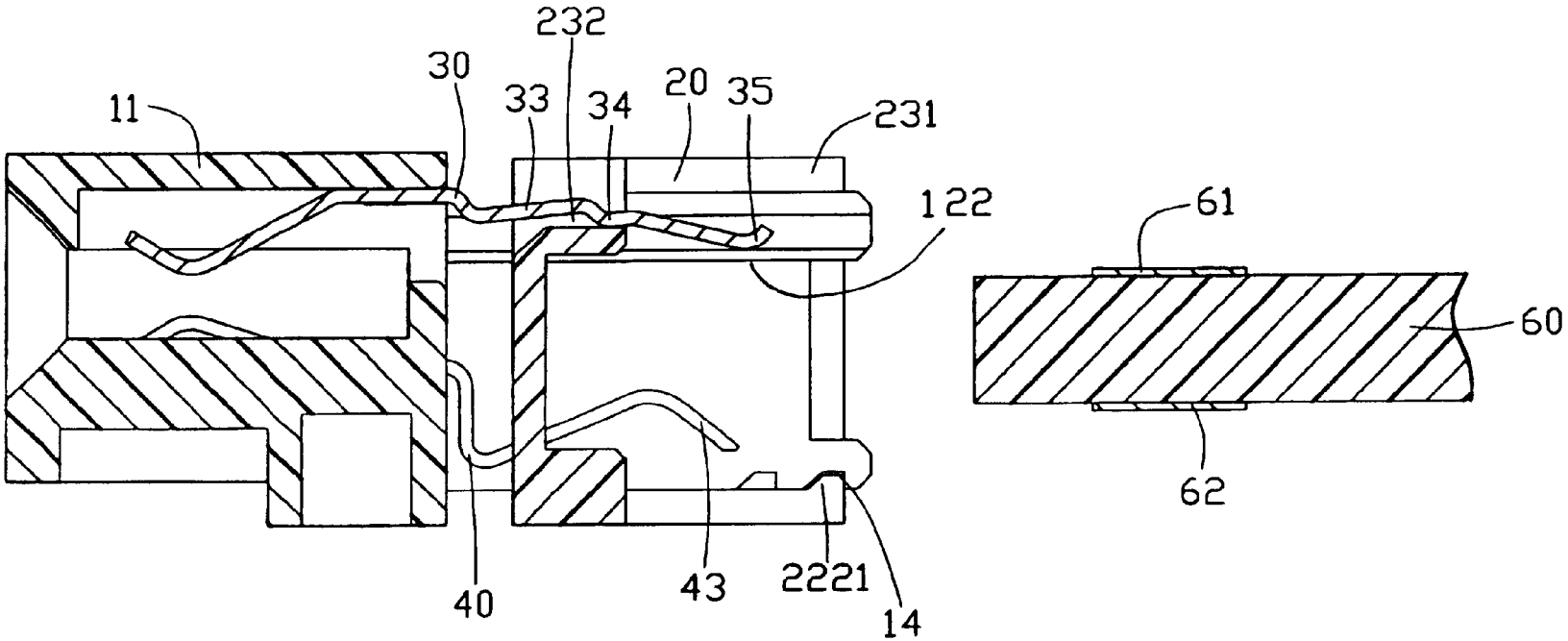
FIG. 4 is a cross-sectional view of FIG. 3 taken along line IV—IV thereof, and showing a cross-section of an edge portion of a PCB ready to be inserted into the connector.

FIG. 4 shows the PCB 60 ready to be inserted into the connector 1. The PCB 60 comprises spaced conductive pads 61, 62 located on opposite surfaces of an edge portion thereof. The conductive pads 61, 62 are coated with solder (not shown).

Figure 3:
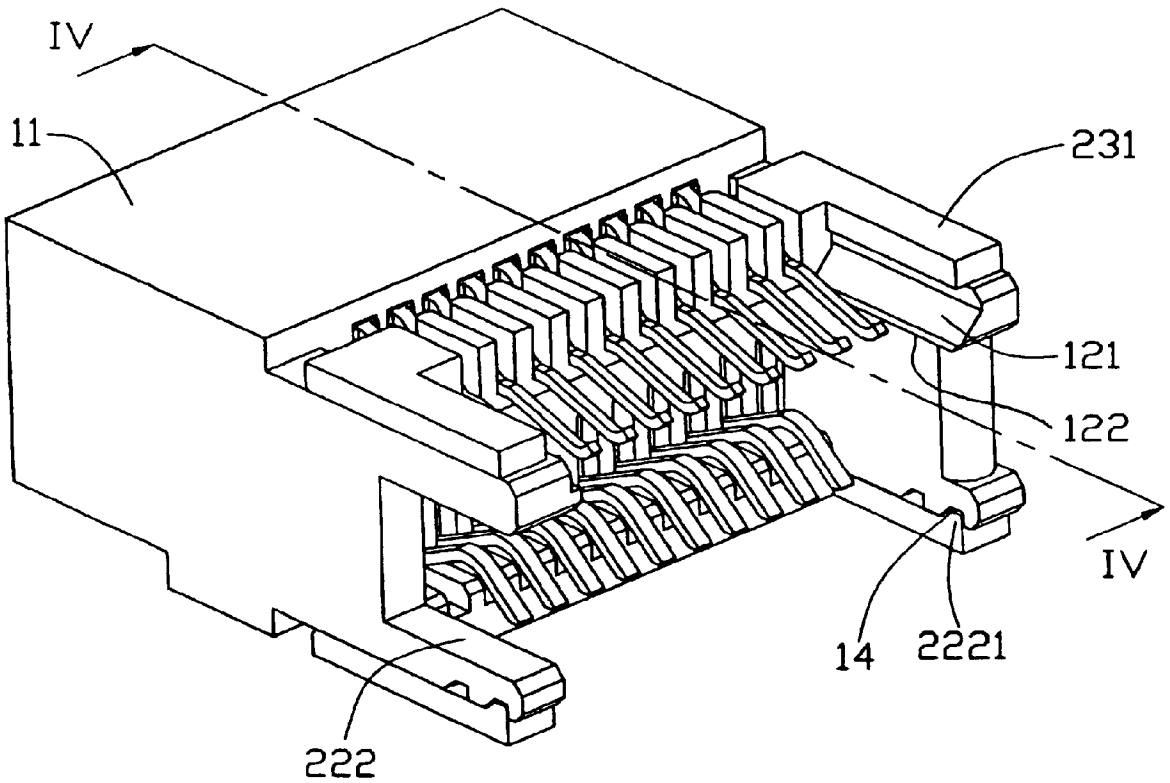
FIG. 3 is an assembled view of FIG. 1.

Referring to FIG. 3, assembly of essential parts of the connector 1 is as follows. Firstly, the upper contacts 30 are partly accommodated in the upper passageways 110, with the upper contacting portions 31 and the upper retaining portions 32 being received in the upper passageways 110. Similarly, the lower contacts 40 are partly accommodated in the lower passageways 111, with the lower contacting portions 41 and the lower retaining portions 42 being received in the lower passageways 111. A shortest distance between the soldering portion 35 of each upper contact 30 and the flexing portion 43 of a corresponding lower contact 40 is less than a thickness of the PCB 60.

The clamp 20 is then attached to the housing 10. The supporting arms 231 of the clamp 20 are slid along tops of the first and second extending portions 12, 13 of the housing 10 respectively, and the positioning arms 222 of the clamp 20 are slid along bottoms of the first and second extending portions 12, 13 respectively. During this process, the guiding slot 234 of the clamp 20 slidingly receives the guiding portion 121 of the housing 10.

The clamp 20 is thus slid toward the body 11 of the housing 10. During this process, the lower contacts 40 are received through the corresponding through slots 213, and retain their normal forms. The upper contacts 30 are received through the corresponding supporting slots 232 via the guiding faces 2321. When the blocks 2221 of the positioning arms 222 of the clamp 20 engage in the positioning slots 14 of the first and second extending portions 12, 13 of the housing 10 respectively, the bent portions 34 of the upper contacts 30 are received in the corresponding supporting slots 232 of the clamp 20. At this position, the upper contacts 30 are bent upwardly. Therefore, the shortest distance between the soldering portion 35 of each upper contact 30 and the flexing portion 43 of the corresponding lower contact 40 is greater than the thickness of the PCB 60 (see FIG. 4).

Figure 5:
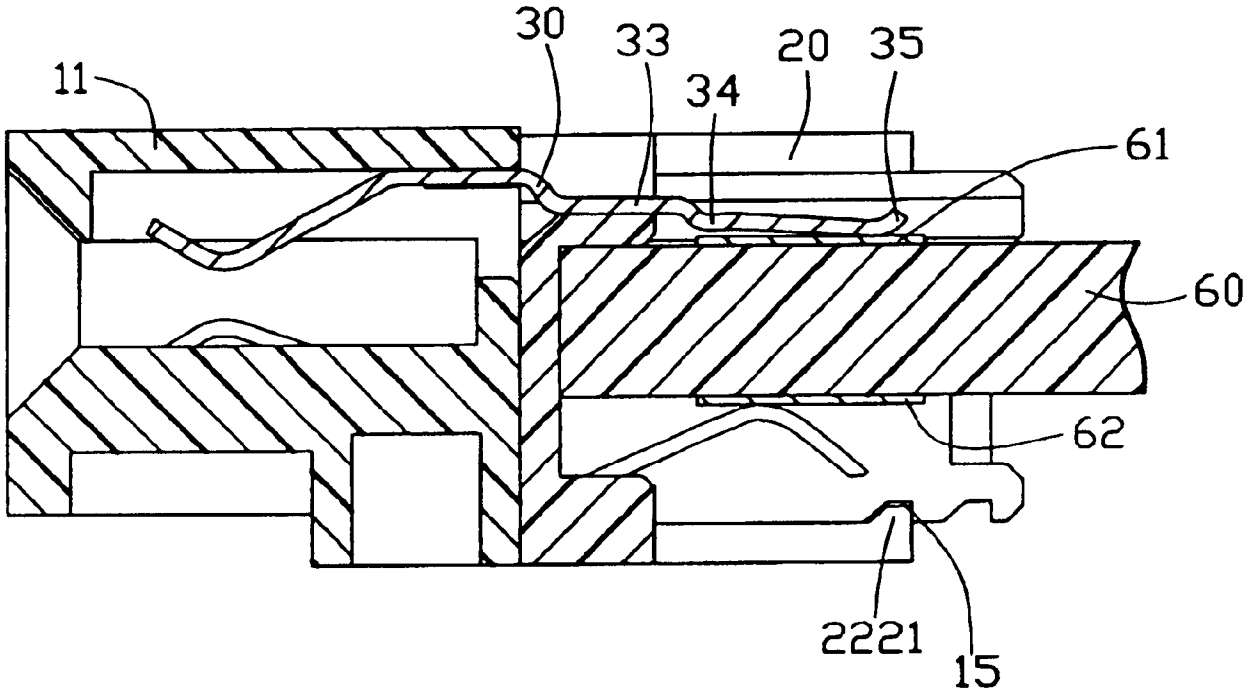
FIG. 5 is similar to FIG. 4, but showing the PCB completely inserted into the connector.
Figure 6:
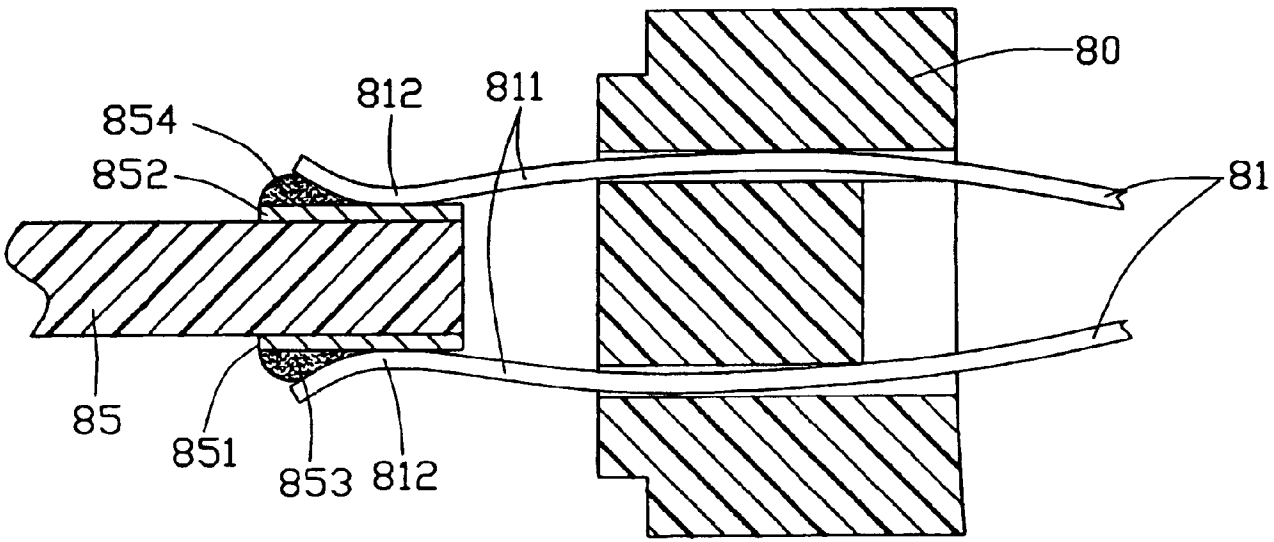
FIG. 6 (PRIOR ART)
FIG. 6 is a cross-sectional view of a conventional straddle electrical connector, and showing a PCB completely inserted into the connector.
Figure 7:
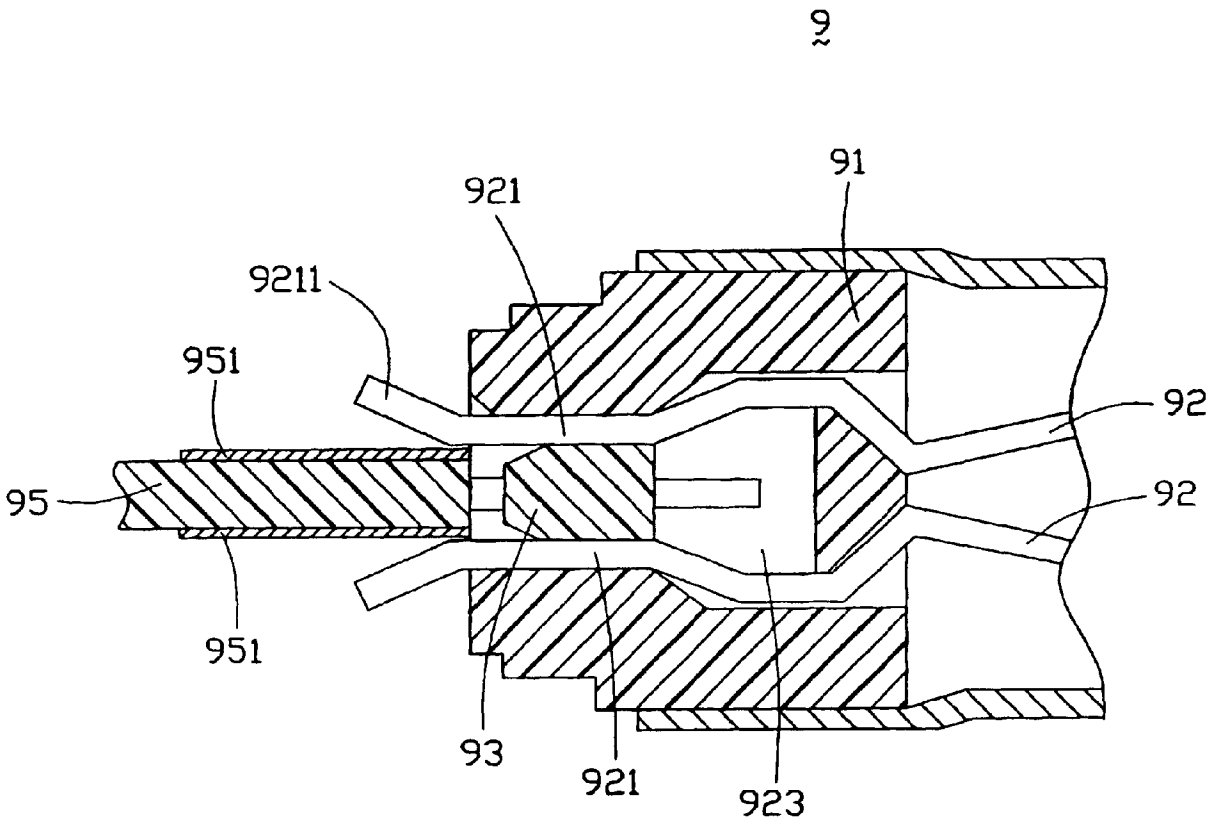
FIG. 7 (PRIOR ART)
FIG. 7 is a cross-sectional view of another conventional straddle electrical connector, and showing a PCB partly inserted into the connector.

Referring to FIG. 4, when the PCB 60 is being inserted in the connector 1, the PCB 60 does not contact the upper contacts 30 or the lower contacts 40. Rather, the PCB 60 makes direct contact with the front surface 211 of the clamp 20. When the PCB 60 is inserted further, the clamp 20 is pushed by the PCB 60 to slide toward the body 11 of the housing 10. Referring to FIG. 5, when the PCB 60 is completely inserted in the connector 1, the blocks 2221 of the positioning arms 222 of the clamp 20 engage in the retaining slots 15 of the first and second extending portions 12, 13 of the housing 10 respectively. At this position, the back surface 212 of the clamp 20 abuts the contacting surface 112 of the housing 10, and the guiding portion 121 of the housing 10 is fully received in the guiding slot 234 of the clamp 20.

As shown in FIG. 5, the bent portions 34 of the upper contacts 30 have exited the supporting slots 232 of the clamp 20, and the connecting portions 33 of the upper contacts 30 are more fully received in the supporting slots 232. As a result, the soldering portions 35 of the upper contacts 30 have resiliently returned to their normal forms. In this final position of the PCB 60 in the connector 1, the soldering portions 35 of the upper contacts 30 and the flexing portions 43 of the lower contacts 40 resiliently press on the solder-coated conductive pads 61, 62 of the PCB 60 respectively. Then, the solder of the conductive pads 61, 62 is melted using an infrared light source or another kind of heat source. In this way, reliable SMT connections between the soldering portions 35, the flexing portions 43, and the corresponding conductive pads 61, 62 are obtained.

As detailed above, when the connector 1 is being connected to the edge of the PCB 60, the shortest distance between the soldering portion 35 of each upper contact 30 and the flexing portion 43 of the corresponding lower contact 40 is firstly enlarged in order to freely accommodate the PCB 60 in the connector 1, and then reduced in order to provide resilient contact between the upper and lower contacts 30, 40 and the corresponding conductive pads 61, 62. This mechanism substantially reduces or even eliminates scraping off of solder from the conductive pads 61, 62 by the upper and lower contacts 30, 40. Thus strong and highly reliable SMT soldering connections are obtained.

In addition, the guiding faces 2321 guide the upper contacts 30 through the corresponding supporting slots 232. Therefore, the soldering portions 35 of the upper contacts 30 do not need to be configured with their own guiding ends. The soldering portions 35 simply have distal ends that are tiny only slightly curved upwardly. Because these distal ends are relatively small, molten solder can easily cover them completely. When the connector 1 transmits high-frequency signals, cross talk involving the distal ends is greatly reduced or even eliminated altogether. Thus, the connector 1 can be made to comply with very high performance and reliability specifications. Understandably, the extending portion 12 defines an guidance face 122 preferably adapted to abut against the side edge portion of the inserted PCB 60 to restrict upward movement of the inserted PCB 60. Therefore, the solder portion 35 will not be jeopardized by the inserted PCB 60 during insertion of the PCB as long as the upper contact 30 is deflected upwardly by the clamp 20 to have the solder portion 35 hidden above the guidance face 122.

While the preferred embodiment in accordance with the present invention has been shown and described, equivalent modifications and changes known to person skilled in the art according to the spirit of the present invention are considered within the scope of the present invention as defined in the appended claims.

What is claimed is:

1. An electrical connector assembly for connection to solder-coated conductive pads on both surfaces of a circuit substrate when completely inserted into the connector, the electrical connector comprising:

an insulative housing having a body with a row of upper and a row of lower receiving passageways defined therein, and a pair of extending portions formed at opposite ends of the body;

a clamp attached with the housing, and comprising a plurality of supporting slots, and a pair of supporting arms engaging with corresponding extending portions of the housing;

a row of upper conductive contacts received in the row of upper receiving passageways of the housing, and comprising bent portions received in the supporting slots of the clamp before the circuit substrate being completely inserted into the connector assembly and soldering portions for pressing on the circuit substrate after the circuit substrate being completely inserted into the connector; and a row of lower conductive contacts received in the row of lower receiving passageways of the housing, and comprising flexing portions for pressing on the circuit substrate after the circuit substrate being completely inserted into the connector;

wherein a shortest distance between the soldering portion of each upper contact and the flexing portion of a corresponding lower contact is greater than a thickness of the circuit substrate.

2. The electrical connector as claimed in claim 1, wherein a plurality of guiding faces are defined in the clamp at the supporting slots for guiding the upper row of contacts through the supporting slots.

3. The electrical connector as claimed in claim 1, wherein each contact comprises a contacting portion and a retaining portion secured in the receiving passageways of the housing.

4. The electrical connector as claimed in claim 3, wherein the bent portion of each upper contact bends downwardly, and a distal end of the soldering portion is curved slightly upwardly.

5. The electrical connector as claimed in claim 1, wherein each extending portion defines a positioning slot and a retaining slot in a bottom thereof.

6. The electrical connector as claimed in claim 5, wherein the clamp further comprises a pair of positioning arms, each positioning arm forms a block, and the blocks engage with the positioning slots and the retaining slots respectively before and after the circuit substrate being completely inserted into the connector.

7. An electrical connector assembly comprising:

an insulative housing defining a pair of extending portions on two opposite ends of a rear portion thereof, each of said extending portions defining a downward facing guidance face;

at least one row of contacts disposed in the housing with tails located between said pair of extending portions;

a clamp mounted to the housing and moveable relative to the housing along a front-to-back direction to have the tails of the contacts hidden above said guidance face; and a printed circuit board, during insertion, having one side edge portion abutting against the guidance face, and a front edge further contacting and urging the clamp to move relative to the housing to allow the tails of the contacts to be lowered to be located below the guidance face and soldered to corresponding pads on the printed circuit board.

* * * * *